US006572367B1

(12) United States Patent
Tranquilli

(10) Patent No.: US 6,572,367 B1
(45) Date of Patent: Jun. 3, 2003

(54) HORIZONTALLY ORIENTED COMBUSTION APPARATUS

(75) Inventor: Nicholas A. Tranquilli, Buffalo, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/152,226

(22) Filed: May 21, 2002

(51) Int. Cl.[7] ..... F23D 14/46
(52) U.S. Cl. ..... 431/353
(58) Field of Search ..... 431/353, 343, 431/2

(56) References Cited

U.S. PATENT DOCUMENTS 2,344,439 A * 3/1944 Lloyd ..... 431/300
5,399,085 A * 3/1995 Taylor ..... 431/353
5,520,537 A * 5/1996 Taylor ..... 431/353
6,231,334 B1 * 5/2001 Bussman et al. ..... 431/5

* cited by examiner

*Primary Examiner*—Henry Bennett
*Assistant Examiner*—Alfred Basichas

(57) ABSTRACT

A combustion chamber for a chiller includes a burner and igniter which are maintained in the horizontal position. The horizontal positioning is implemented by a steel casting, which includes a thick flange portion. The thick flange portion is between the combustion chamber and the outside surface, therefore keeping the outside surface cooler. The steel casting has a mitered extension of the combustion chamber, which allows for more efficient heat transfer. By orienting the burner and igniter in the steel casting in the horizontal position, one eliminates prior art ceramic annular cooling devices. The horizontal orientation enables the overall height of the generator to be decreased and also allows for easy access during installation and maintenance of the burner and igniter.

10 Claims, 5 Drawing Sheets

HORIZONTALLY ORIENTED COMBUSTION APPARATUS

FIELD OF INVENTION

This invention relates to a combustion chamber apparatus and more particularly, to a burner and igniter of a combustion chamber having a horizontal orientation for use in an aqua-ammonia absorption chiller.

BACKGROUND OF THE INVENTION

A combustion chamber basically operates to accommodate detonation of a fuel which may be a gas to achieve optimum operation. While there are many uses for combustion chambers, a particular application employs a combustion chamber in an aqua-ammonia absorption chiller. Such chillers operate to heat a solution of water and ammonia used as a refrigerant to convert the solution to a gas which cools as it condenses. In such chillers, a combustion chamber which includes a burner and an igniter is used to heat the solution and to convert it to a gas.

In any event, the prior art combustion chambers for such chillers are oriented in the vertical position and because of such orientation, they are difficult to maintain. Utilizing a vertical orientation for the burner and igniter in such a combustion chamber resulted in various difficulties in the prior art. One difficulty was the vertical configuration required a larger vertical profile, which therefore made the unit difficult to repair and maintain, as well as difficult to install. Because of the orientation, the installation and maintenance of various portions of the vertical burner and igniter caused breakage during installation, as well as various other problems. The prior art unit was difficult to repair and maintain.

In any event, it is an object of the present invention to provide an improved burner ignition configuration to be employed in a chiller combustion chamber in which the configuration is arranged in a horizontal orientation.

SUMMARY OF INVENTION

A horizontal combustion chamber uses a mitered extension of a combustion chamber casting. The casting has a flange portion which eliminates the need for a ceramic cooling ring. The flange portion on the casting is of an increased thickness and therefore, provides more thermal isolation between the inner combustion chamber and the outside surface of the housing. By utilizing a horizontal orientation, the clearance between the outer diameter of the burner and the flange is decreased. This creates a volume for cooling to occur, while the increased wall thickness of the chamber allows for a heat sink effect. The use of the horizontal orientation allowed the overall height of the generator to be decreased and also enabled full access during installation and maintenance of the burner and igniter, resulting in a significant savings of maintenance time.

DETAILED DESCRIPTION OF THE FIGURES

Figure 1:
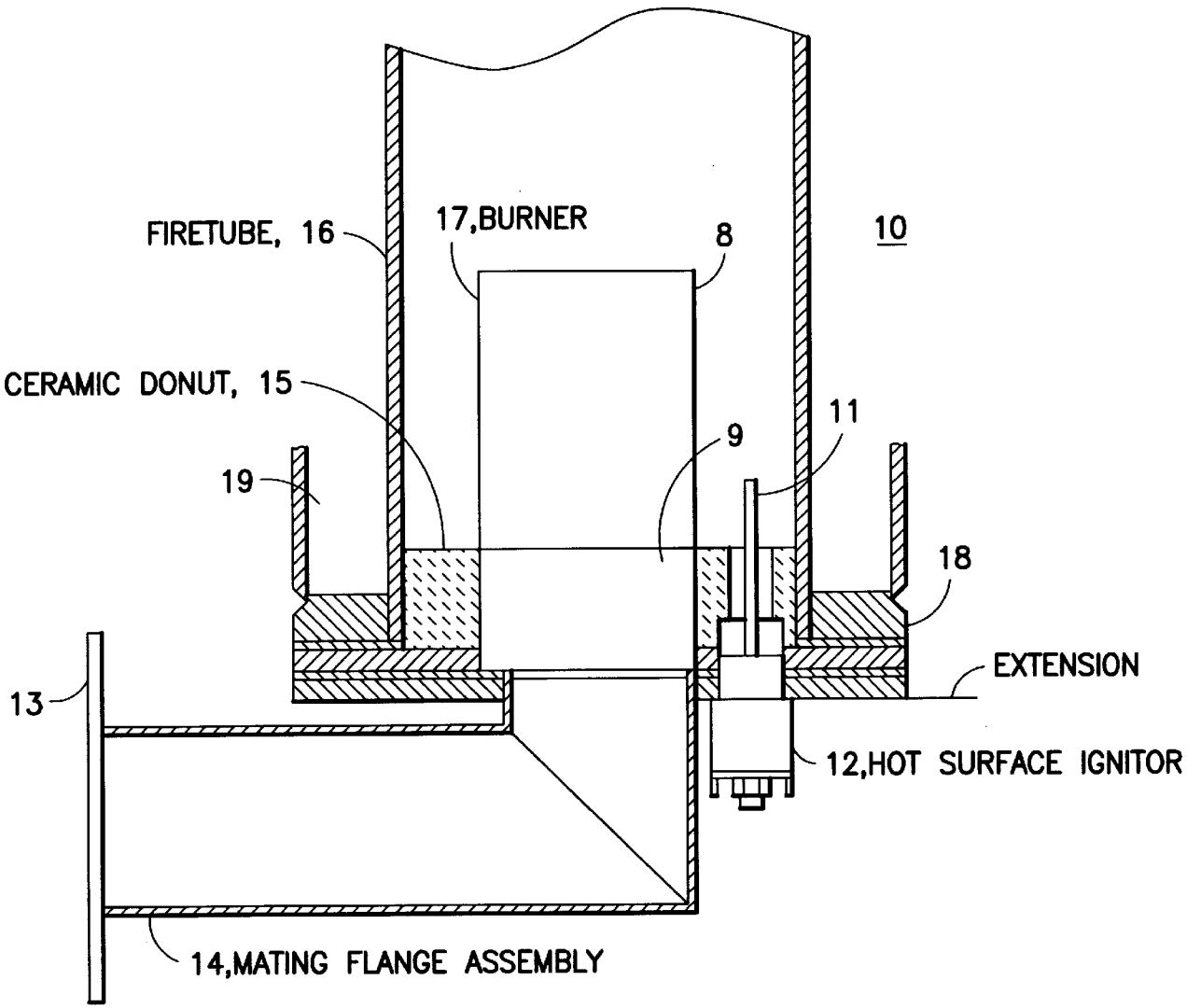
FIG. 1 PRIOR ART
FIG. 1 is a cross sectional view of the prior art combustion chamber burner ignition system.

Referring to FIG. 1 there is shown a prior art vertical burner and igniter 10 positioned in a combustion chamber of a gas fire generator. As one can see, the burner 17 has a top portion 8 which is basically of a mesh-like or perforated configuration and has a bottom portion, which is non-perforated. The burner, as utilized in conjunction with combustion chambers, allows a gas to flow therethrough which gas is ignited by means of a hot surface igniter 12 having a graphite rod 11, which basically forms the hot surface for ignition. Gas is introduced into the chamber by the mating flange 14 which is a tube and is connected to a blower (not shown) at flange 13. The blower introduces the gas into the burner, which gas is ignited by the hot surface igniter 12. As can be seen, the bottom metal portion 9 of the burner is surrounded by a ceramic donut or annular ceramic ring 15. This donut section is extremely fragile and difficult to work with. It is also noted that after firing, the ceramic material can become carcinogenic and therefore, may present problems to maintenance workers who work with and otherwise maintain the burner.

The configuration of FIG. 1 is in the vertical orientation and is mounted on the mating flange assembly 14, which is associated with the gas-fired generator. In such vertical orientations, the difficulty is with the mounting of the flange portion under the generator, as well as additional parts needed for mating the flange assembly to the burner and igniter. As one can see, the additional parts are referenced by numeral 18 and consist of retaining rings and additional insulating devices which mount to the mating flange assembly 14. As one can also see by the arrows marked "extension", there was an additional extension required under the generator to allow for installation and maintenance of the burner and for the mating flange assembly. This essentially increases the overall height of the generator by many inches. This becomes a problem in regard to increasing the overall height of the final chiller assembly.

As seen, the burner 17 is surrounded by an inner vertical tube or fire tube 16. Fire tube 16 is surrounded by an outer tube or outer shell 19 (partially shown). The outer tube 19 accommodates the aqua-ammonia solution which is headed by the burner 17, transferring heat through the fire tube 16. The fire tube 16 has to be supported by the additional ancillary parts 18, including extending flanges and so on. In order to gain access to the burner 17 and the igniter 12, a great deal of maintenance time was involved in removing the coupling structures to gain access to the burner and igniter 12. It is noted that the fire tube 16 and the outer tube or fluid containing shell 18 are vertically oriented. The hot surface igniter 12 is also vertical and during installation or maintenance, the graphite tip 11 would often be broken, resulting in additional expense and time.

Figure 2A:
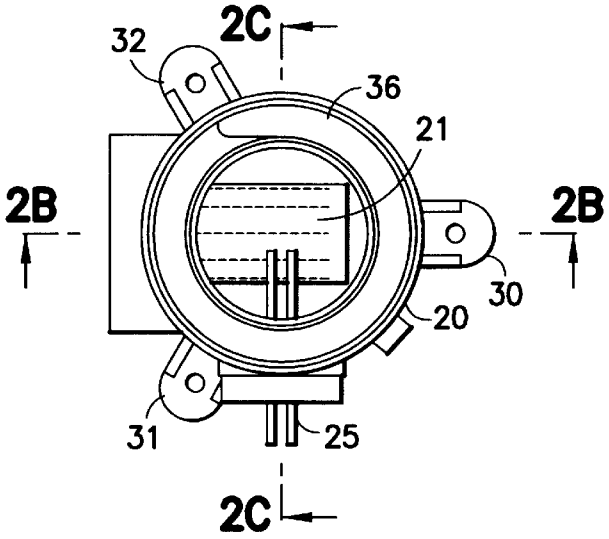
FIG. 2A is a front view of a combustion chamber according to this invention.
Figure 2C:
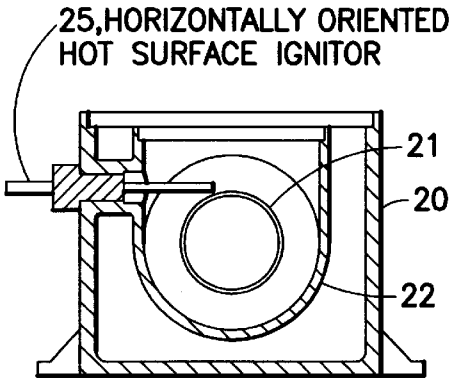
FIG. 2C is a cross sectional view taken through a section line CC of FIG. 2.
Figure 2B:
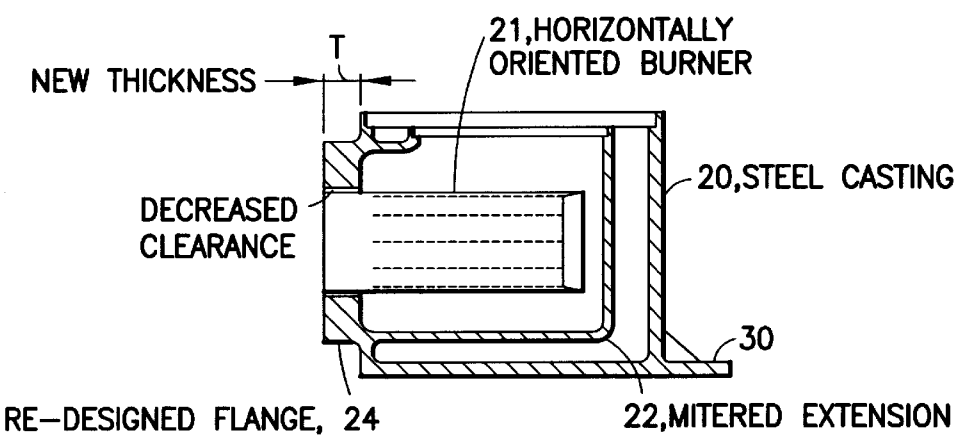
FIG. 2B is a cross sectional view taken through a section line BB of FIG. 2.

FIG. 2A shows a front view of a combustion chamber consisting of a burner and igniter in a horizontal orientation. FIG. 2B is a section through line BB of FIG. 2A, while FIG. 2C is a section through line CC of FIG. 2A. As will be explained, the burner 21 and igniter 25 are held in a horizontal position by creating a mitered extension of the combustion chamber in a steel casting. The casting also has a flange portion 24 which has been designed to eliminate the need for the ceramic donut 15 as shown in FIG. 1. The design of the flange portion 24 of the casting increases the thickness of the material between the inside of the combustion chamber and the outside surface. This is shown in FIG. 2B by the designation T. The casting decreases the clearance between the outer diameter of the non-perforated section of the burner and the flange. This creates a volume for cooling to occur while the increased wall thickness allows for a heat-sink effect. The orientation allows the elimination of the mating flange assembly (14 of FIG. 1), as well as the ceramic donut (15 of FIG. 1) which, as indicated, is needed for high temperature. The improved configuration also allowed the overall height of the generator to be decreased by eliminating the need for the extended height as shown in FIG. 1 depicted by the arrows marked "extension". The casting enables full access during installation and maintenance of the burner and igniter and therefore eliminates the problems with parts breaking as, for example, the graphite rod 11.

Again, referring to FIG. 2A there is shown the steel casting 20 which has positioned therein the burner 21. Burner 21 is the same as burner 17 of FIG. 1. Burner 21, as indicated in FIG. 2B, is essentially maintained in a front portion of the casting, which has the thick integral flange 24. The burner is held in position by means of an end flange located on the non-perforated bottom portion of the burner. As indicated and shown in FIG. 2A, the steel casting has mounting tabs 30, 31 and 32, which are integrally formed in the casting. Also shown in FIG. 2B is that the burner, which is horizontally oriented, is now surrounded by the mitered section 22. The mitered extension basically surrounds the burner. As one can see, there is a front opening 36. This front opening enables one to accommodate the fire tube and the outer shell.

As one can see, the igniter 25 is in a horizontal position and is now transverse to the central axis of the burner 21 instead of being parallel to the central axis of the burner (FIG. 1). This allows for improved operation and maintenance.

Figure 3:
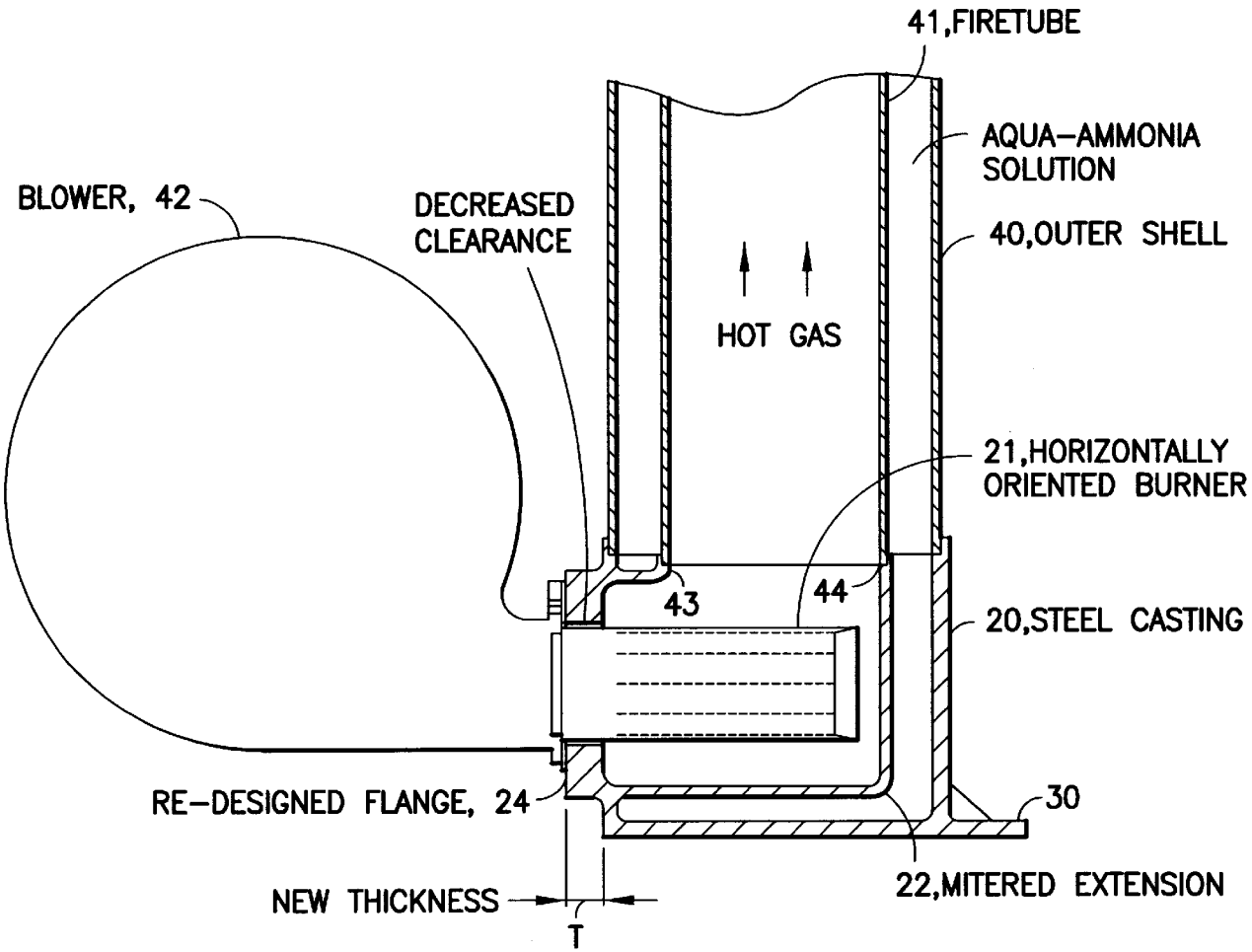
FIG. 3 is cross sectional view as in FIG. 2B, depicting the casting coupled to a fire tube and outer shell on a blower.

Referring to FIG. 3 there is shown a similar section as of FIG. 2B depicting the combustion chamber and to show how it is utilized in the chiller. As seen in FIG. 3 the steel casting 20, which includes the mitered extension 22, enables an outer shell 40 to be accommodated between the outer wall of the steel casting and the mitered section. Thus, the outer shell is inserted within the front aperture of the housing and is held in position, as depicted in FIG. 3. In a similar manner, the fire tube 41 is inserted in the front aperture and is supported by the mitered section of the housing indicated by numerals 43 and 44 at the support points. As one can also see, a blower 42 is secured to the thick flange 24, where it is bolted to the flange. In a similar manner, the burner 21 can also be bolted to the thick flange by means of a conventional coupling. The blower 42, as indicated, circulates ignitable gas which may be ordinary gas or propane to the burner, the burner in turn is heated by the gas, as shown in FIG. 3 by the arrows, where hot gas flows through the fire tube to heat the aqua-ammonia solution, which circulates between the fire tube outer wall 41 and the outer shell 40. One can actually compare FIG. 3 to FIG. 1 to show how the similar components are accommodated, such as the outer shell and fire tube, as well as the blower assembly and the remaining modules. It is also seen from FIG. 3, as will be further explained, that the casting for the combustion chamber and burner accommodating assembly is compact and easy to access.

Figure 4:
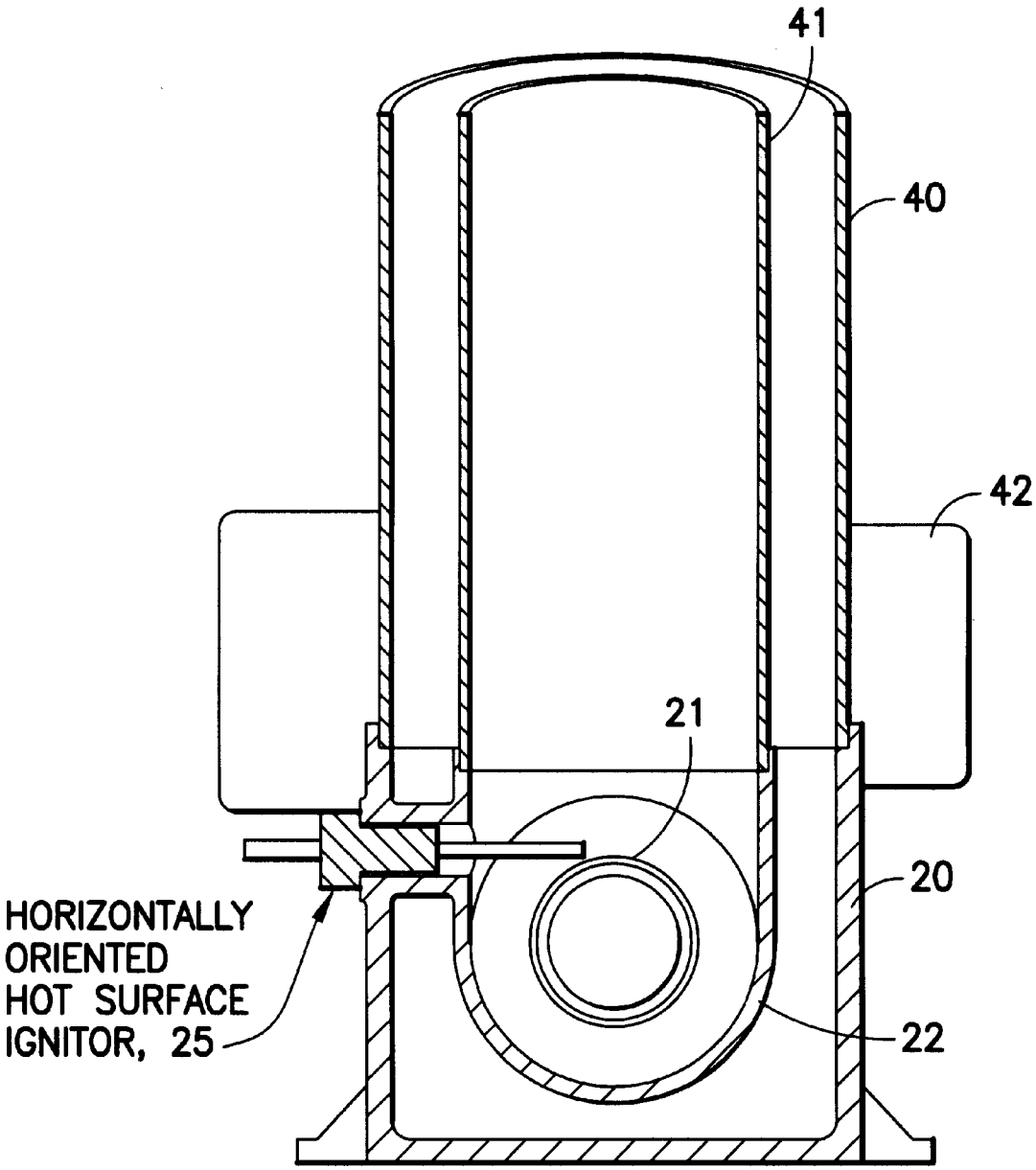
FIG. 4 is a view as in FIG. 2C, depicting the various components coupled to the casting.

FIG. 4 shows the steel casting 20 in the orientation as depicted in FIG. 2C, accommodating the outer shell 40 and the fire tube 41. Also seen in FIG. 4 is the horizontally oriented hot surface igniter 25, as positioned with respect to the horizontally oriented burner 21.

Figure 5:
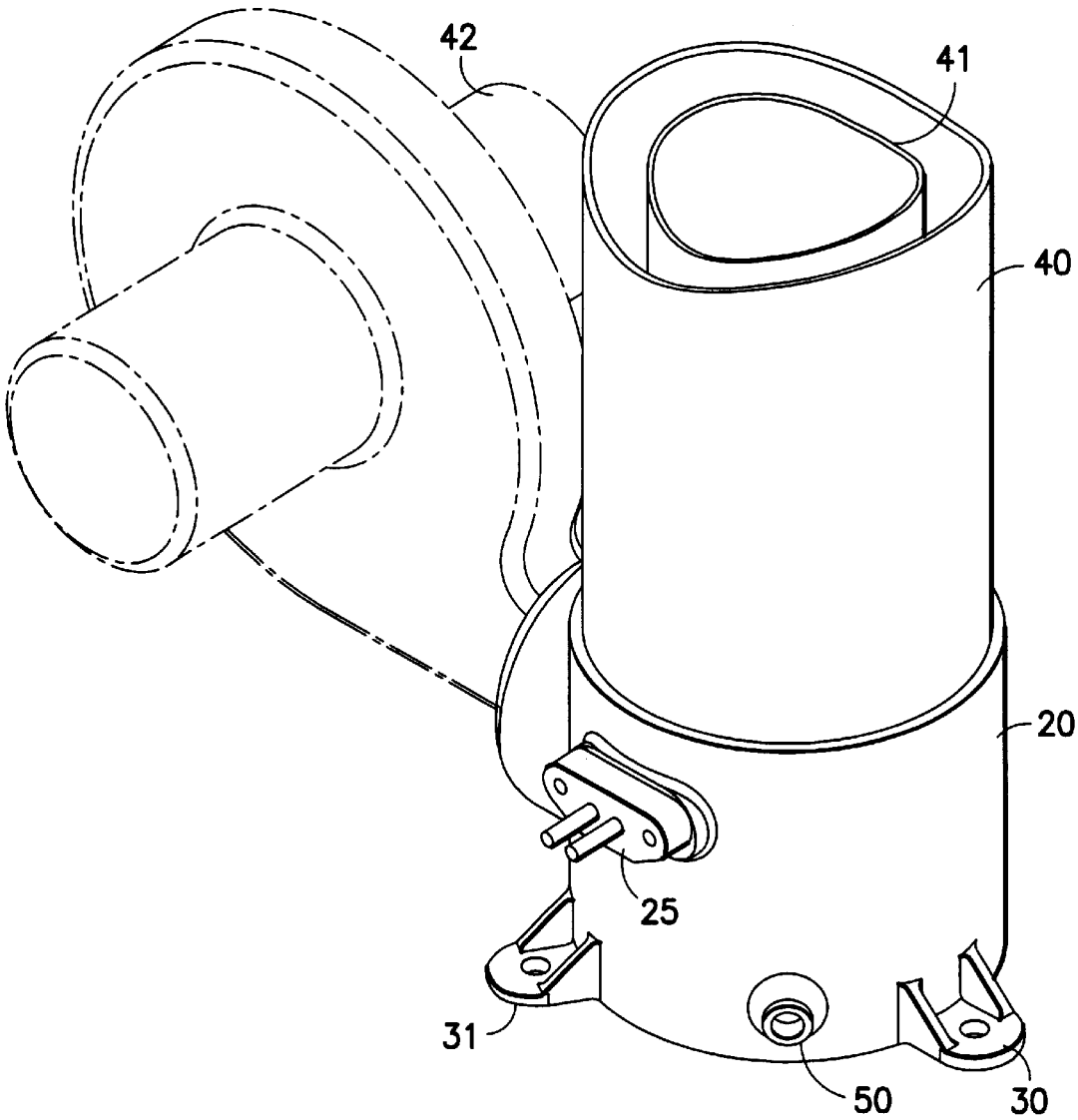
FIG. 5 is a perspective view of the casting assembly accommodating the various components associated with the chiller according to this invention.

Referring to FIG. 5, there is shown a perspective view of the steel casting 20 accommodating the fire tube 41 and the outer shell 40 and can also see the output electrodes of the hot surface igniter 25 and the blower 42 coupled to the blower input port of the assembly. As seen in FIG. 5, it is a very compact assembly whereby the tabs 30 and 31 can be mounted to the corresponding surface of the chiller and the entire unit as shown in FIG. 5, with the exception of the blower, can be assembled onto the chiller. As can be seen clearly in FIG. 5, the blower is coupled to the input port which contains the horizontal oriented burner. The steel casting 20 is cylindrical in shape and has a top opening where the outer chamber of the casting is a closed chamber to accommodate the aqua-ammonia solution, while the inner chamber portion accommodates the burner, which is cylindrical in shape and also is coupled to a blower port so that gas can enter the combustion inner chamber and be ignited by means of a horizontally oriented hot surface igniter. The gas circulating in the fire tube 41 heats the fluid in the outer shell, as is known. A drainage port 50 is shown, which port is coupled to the inner chamber and operative to drain fluid from the inner chamber during maintenance. The port 50 can be covered by a suitable cap or other device.

The Scope of the Invention

The dimensions and geometries for any of the embodiments described herein are merely for illustrative purposes and, as much, any other dimensions may be used if desired, depending on the application, size, performance, manufacturing requirements, or other factors, in view of the teachings herein.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein without departing from the spirit and scope of the present invention.

What is claimed is:

1. A combustion chamber for igniting a combustible gas, comprising:

a housing chamber of a cylindrical configuration having a top surface and a bottom surface surrounded by a cylindrical sidewall, said housing oriented in the vertical discretion and supported by said bottom surface, said top surface having an opening, said opening communicating with a first inner chamber of said housing, said inner chamber communicating with a side surface of said housing via an aperture transverse to said top opening and for accommodating a cylindrical burner in a horizontal orientation, an outer chamber in said housing surrounding said inner chamber and totally isolated therefrom with said outer chamber communicating with said opening, whereby said inner chamber of said housing is adapted to receive a fire tube at said opening for circulating hot gases, with said outer chamber adapted to receive an outer shell for accommodating a fluid to be heated, and an igniter port located on a surface of said housing for accommodating an igniter, said port directed into said inner chamber of said housing for accommodating the igniter to be positioned in said inner chamber and operative to ignite a combustible gas flowing through said burner.

2. The combustion chamber according to claim 1 wherein said housing is fabricated from steel.

3. The combustion chamber according to claim 1 wherein said first side surface of said housing is substantially thick about said aperture, as compared to the thickness of other surfaces of said housing.

4. The combustion chamber according to claim 1 wherein said fluid accommodated by said outer shell is an aqua-ammonia solution to be heated.

5. The combustion chamber according to claim 1 wherein said housing is a steel casting.

6. The combustion chamber according to claim 1 wherein said housing has extending tabs from the side surface close to said bottom surface for retaining said housing in said vertical direction.

7. The combustion chamber according to claim 1 wherein said fire tube and outer shell extend in the vertical direction.

8. The combustion chamber according to claim 1 wherein said igniter is a hot surface igniter.

9. The combustion chamber according to claim 1 wherein said burner has a top perforated area and a non-perforated bottom area which bottom area is accommodated by said aperture.

10. The combustion chamber according to claim 1 wherein said igniter is oriented in the horizontal direction.

* * * * *

UNITED STATES PATENT AND TRADEMARK OFFICE

CERTIFICATE OF CORRECTION

PATENT NO. : 6,572,367 B1
DATED : June 3, 2003
INVENTOR(S) : Tranquilli

It is certified that error appears in the above-identified patent and that said Letters Patent is hereby corrected as shown below:

Column 4,
Line 55, "discretion" should be -- direction --
Line 59, "top" should be deleted Signed and Sealed this Thirtieth Day of December, 2003

JAMES E. ROGAN
*Director of the United States Patent and Trademark Office*